US011371708B2

(12) United States Patent
Thariyan et al.

(10) Patent No.: US 11,371,708 B2
(45) Date of Patent: Jun. 28, 2022

(54) PREMIXER FOR LOW EMISSIONS GAS TURBINE COMBUSTOR

(71) Applicant: General Electric Company, Schenectady, NY (US)

(72) Inventors: Mathew Paul Thariyan, Niskayuna, NY (US); Manampathy Gangadharan Giridharan, West Chester, OH (US); Kapil Kumar Singh, Niskayuna, NY (US); Sravan Kumar Dheeraj Kapilavai, Niskayuna, NY (US); Keith Robert McManus, Niskayuna, NY (US); Gregory Allen Boardman, West Chester, OH (US); Mark David Durbin, West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/043,004

(22) PCT Filed: Apr. 6, 2018

(86) PCT No.: PCT/US2018/026431
§ 371 (c)(1),
(2) Date: Sep. 29, 2020

(87) PCT Pub. No.: WO2019/194817
PCT Pub. Date: Oct. 10, 2019

(65) Prior Publication Data
US 2021/0010674 A1 Jan. 14, 2021

(51) Int. Cl.
*F23R 3/14* (2006.01)
*F23R 3/28* (2006.01)
*F23R 3/20* (2006.01)

(52) U.S. Cl.
CPC ..... *F23R 3/286* (2013.01); *F23R 3/14* (2013.01); *F23R 3/20* (2013.01)

(58) Field of Classification Search
CPC ..... F23R 3/14; F23R 3/286
See application file for complete search history.

(56) References Cited

U.S. PATENT DOCUMENTS 3,915,387 A * 10/1975 Caruel ..... F23R 3/14 239/400
5,251,447 A * 10/1993 Joshi ..... F23R 3/14 239/403

(Continued)

FOREIGN PATENT DOCUMENTS

JP 2005-106411 A 4/2005

OTHER PUBLICATIONS

International Search Report of the International Searching Authority for PCT/US2018/026431 with dated Dec. 21, 2018.

*Primary Examiner* — William H Rodriguez
(74) *Attorney, Agent, or Firm* — Dority & Manning, P.A.

(57) ABSTRACT

A premixer for a gas turbine combustor includes a center-body, a swirler assembly, and a mixing duct. The swirler assembly includes an inner swirler with vanes that rotate air in a first direction and an outer swirler with vanes that rotate air in an opposite direction. The inner swirler vanes and the outer swirler vanes are separated by an annular splitter. The outer swirler vanes define an outlet plane, and the inner swirler vanes each have a trailing edge that is disposed at an acute angle relative to the outlet plane. In one aspect, the inner swirler is axially offset from the outer swirler. The mixing duct may also define fuel passages that deliver fuel to fuel outlets on the downstream end of the mixing duct. The premixer is designed for operation on gaseous fuel or liquid fuel.

19 Claims, 10 Drawing Sheets

(56) References Cited

U.S. PATENT DOCUMENTS 5,590,529 A * 1/1997 Joshi ..... F23R 3/14 60/737
5,613,363 A * 3/1997 Joshi ..... F23D 11/107 60/737
5,675,971 A * 10/1997 Angel ..... F23R 3/286 239/405
5,680,766 A * 10/1997 Joshi ..... F23C 7/004 239/405
6,141,967 A * 11/2000 Angel ..... F23R 3/14 239/405
6,301,899 B1 * 10/2001 Dean ..... F23C 7/004 60/737
6,334,309 B1 * 1/2002 Dean ..... F23D 11/101 60/737
6,381,964 B1 * 5/2002 Pritchard, Jr. ..... F23R 3/14 60/746
6,415,594 B1 * 7/2002 Durbin ..... F23R 3/286 60/748
6,453,660 B1 * 9/2002 Johnson ..... F23C 99/00 60/39.821
6,871,501 B2 * 3/2005 Bibler ..... F23R 3/002 60/772
6,901,756 B2 6/2005 Gerendas et al.
7,059,135 B2 * 6/2006 Held ..... F23R 3/14 60/748
7,596,949 B2 * 10/2009 DeVane ..... F23R 3/002 60/748
9,534,788 B2 * 1/2017 Li ..... F23R 3/14
10,851,659 B2 * 12/2020 Yang ..... F01D 9/041
2001/0042375 A1 * 11/2001 Nishida ..... F23R 3/343 60/737
2004/0079086 A1 * 4/2004 Smith ..... F23R 3/18 60/776
2007/0289305 A1 * 12/2007 Oda ..... F23R 3/283 60/748
2007/0289306 A1 * 12/2007 Suria ..... F23R 3/14 60/748
2010/0308135 A1 * 12/2010 Yamamoto ..... F23R 3/343 239/402
2011/0252802 A1 10/2011 Lacy et al.
2012/0304649 A1 * 12/2012 Matsuyama ..... F23R 3/286 60/737
2013/0327849 A1 * 12/2013 Matsuyama ..... F23R 3/286 239/406
2015/0285503 A1 * 10/2015 Li ..... F23R 3/14 60/772
2017/0003030 A1 * 1/2017 Benjamin ..... F23R 3/283
2018/0266693 A1 * 9/2018 Patel ..... F23R 3/343
2018/0298824 A1 * 10/2018 Matsuyama ..... F23R 3/28
2020/0208575 A1 * 7/2020 Matsumura ..... F23R 3/18
2020/0355371 A1 * 11/2020 Lind ..... F23R 3/10

* cited by examiner

PREMIXER FOR LOW EMISSIONS GAS TURBINE COMBUSTOR

TECHNICAL FIELD

The present technology relates generally to a low emissions combustor of a gas turbine engine and, more specifically, to a premixer for such a combustor. The premixer uniformly mixes fuel and air to reduce NOx formed by the ignition of the fuel-air mixture, while minimizing auto-ignition and flashback within the premixer itself. The premixer is classified as a dual fuel premixer, which operates alternately on gaseous fuel and liquid fuel.

BACKGROUND

A modern industrial gas turbine, as may be used for electrical power generation, may be designed with an annular combustor. In an annular combustor, the combustion chamber is defined circumferentially between inner and outer side walls and axially between the inlet plane and the discharge plane. A domed end defines the inlet plane of a combustion zone. Mounted to the domed end at the head end of the combustor is a ring of air-fuel premixers, which inject mixture of gaseous and/or liquid fuel and air into the combustion zone. The combustion gases produced by the premixers travel from the combustion zone through a transition zone before being discharged from the aft end of the combustor to perform work within the turbine.

Generally, an air-fuel premixer includes a mixing duct, a centerbody fuel injector located within the mixing duct, a set of inner and outer counter-rotating swirler vanes adjacent to the upstream end of the mixing duct, and an annular splitter separating the inner and outer swirlers to allow independent rotation of the air flow therethrough. This type of premixer may be referred to as a double annular counter-rotating swirl (DACRS) fuel nozzle. Often, to permit greatest operational flexibility, these air-fuel premixers are configured to alternate between burning gaseous fuel and burning liquid fuel, where liquid fuel is conveyed through the centerbody and gaseous fuel is conveyed through the outer swirler vanes.

In designing an air-fuel premixer, it is necessary to set the mixing duct length to be long enough for adequate air-fuel mixing, but not so long as to promote auto-ignition within the mixing duct. Providing a well-mixed air-fuel mixture to the combustion zone results in lower NOx emissions. However, it has been observed that air flow passing the inner swirler expands and forms a recirculation zone (vortex) around the centerbody. As a result, the fuel injected into the recirculation zone tends to have a long residence time during which fuel mixes with the air flow, potentially leading to auto-ignition within the mixing duct and thereby damaging components of the air-fuel premixer. This risk is heightened when the premixer is operating on liquid fuel.

Managing combustion dynamics is another challenge to be overcome in the design of premixers for combustors that operate in a premixed mode of operation. Combustion instabilities may occur during operation when one or more acoustic modes of the gas turbine are excited by the combustion process. For example, one mechanism of combustion instabilities may occur when the acoustic pressure pulsations cause a mass flow fluctuation at a fuel port which then results in a fuel/air ratio fluctuation in the flame. When the resulting fuel/air ratio fluctuation and the acoustic pressure pulsations have a certain phase behavior (e.g., in-phase or approximately in-phase), a self-excited feedback loop may result. This mechanism, and the resulting magnitude of the combustion dynamics, depends at least in part on the delay between the time that the fuel is injected through the fuel ports and the time when the fuel reaches the combustion chamber and ignites, defined as "convective time." Generally, there is an inverse relationship between convective time and frequency: that is, when the convective time increases, the frequency of the combustion instabilities decreases; and when the convective time decreases, the frequency of the combustion instabilities increases.

At particular operating conditions, combustion dynamics at specific frequencies and with sufficient amplitudes, which are in-phase and coherent, may produce undesirable sympathetic vibrations in the turbine and/or other downstream components. Over time, if left unchecked, the resulting combustion dynamics can negatively impact hardware life and/or turbine operation.

Therefore, there is a desire for a premixer for a gas turbine engine, which operates reliably on either gaseous or liquid fuel, which uniformly mixes fuel with air prior to combustion to reduce NOx emissions, which eliminates recirculation zones to prevent auto-ignition and flashback, and, optionally, which alters convective time to reduce combustion dynamics.

SUMMARY

A premixer for a gas turbine combustor includes a centerbody, a swirler assembly, and a mixing duct. The swirler assembly includes an inner swirler with vanes that rotate air in a first direction and an outer swirler with vanes that rotate air in an opposite direction. The inner swirler vanes and the outer swirler vanes are separated by an annular splitter. The outer swirler vanes define an outlet plane, and the inner swirler vanes each have a trailing edge that is disposed at an acute angle relative to the outlet plane. In one aspect, the inner swirler is axially offset from the outer swirler. The mixing duct may also define fuel passages that deliver fuel to fuel outlets on the downstream end of the mixing duct. The premixer is designed for operation on gaseous fuel or liquid fuel.

In a first aspect provided herein, a premixer includes a centerbody, a swirler assembly, and a mixing duct. The centerbody is disposed along a longitudinal axis of the premixer and defines a fuel passage therethrough. Fuel ports in communication with the fuel passage are defined through a centerbody wall. The swirler assembly includes a hub circumferentially surrounding a portion of the centerbody upstream of the fuel ports. An annular splitter circumferentially surrounds and is radial outward of the hub. An inner swirler includes inner swirler vanes that extend between the hub and the annular splitter to impart swirl in a first direction to a flow of incoming air. An outer swirler includes outer swirler vanes that extend radially outward of the annular splitter to impart swirl in a second direction opposite the first direction to the flow of incoming air. The outer swirler defines an outlet plane, and each inner swirler vane of the inner swirler includes a trailing edge disposed at an oblique angle relative to the outlet plane. The mixing duct, which extends downstream from the swirler assembly, defines a mixing chamber configured to promote mixing of the flow of incoming air and fuel.

In accordance with a second aspect of the technology, a dual fuel premixer for a gas turbine combustor is provided. The dual fuel premixer includes a centerbody, a hub partially surrounding the centerbody, a first array of inner swirler vanes extending from the hub, an annular splitter surrounding the hub and the first array of inner swirler vanes, a second array of outer swirler vanes extending radially outward of the annular splitter, an outer ring surrounding the annular splitter and the second array of outer swirler vanes, and a mixing duct. The centerbody is disposed along a longitudinal axis of the dual fuel premixer and defines a fuel passage and fuel ports in communication with the fuel passage. The fuel ports are defined through a centerbody wall. The hub circumferentially surrounds a portion of the centerbody upstream of the fuel ports. The annular splitter circumferentially surrounds and is radially outward of the hub. An outer ring circumferentially surrounds and is radially outward of the annular splitter and defines a primary fuel plenum within the outer ring. The first array of inner swirler vanes extends between the hub and the annular splitter to impart swirl in a first direction to a flow of incoming air. The second array of outer swirler vanes extends between the annular splitter and the primary fuel plenum to impart swirl in a second direction opposite the first direction to the flow of incoming air. Each outer swirler vane of the second array defines at least one fuel metering hole therein in fluid communication with the primary fuel plenum. The mixing duct, which extends downstream from the primary fuel plenum, defines a mixing chamber configured to promote mixing of the flow of incoming air and fuel. Each inner swirler vane of the first array has a first portion connected to the hub and a second portion connected to the annular splitter, the first portion being shorter than the second portion, such that an imaginary line drawn between a downstream end of the first portion and a downstream end of the second portion defines an oblique angle relative to an outlet plane defined by the second array of outer swirler vanes.

BRIEF DESCRIPTION OF THE DRAWINGS

The specification, directed to one of ordinary skill in the art, sets forth a full and enabling disclosure of the present system and method, including the best mode of using the same. The specification refers to the appended figures, in which.

DETAILED DESCRIPTION

To clearly describe the current dual fuel premixers, certain terminology will be used to refer to and describe relevant machine components within the scope of this disclosure. To the extent possible, common industry terminology will be used and employed in a manner consistent with the accepted meaning of the terms. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, as described below. As used herein, "downstream" and "upstream" are terms that indicate a direction relative to the flow of a fluid, such as the working fluid through the turbine engine. The term "downstream" corresponds to the direction of flow of the fluid, and the term "upstream" refers to the direction opposite to the flow (i.e., the direction from which the fluid flows). The terms "forward" and "aft," without any further specificity, refer to relative position, with "forward" being used to describe components or surfaces located toward the front (inlet) end of the combustor, and "aft" being used to describe components located toward the rearward (outlet) end of the combustor. Additionally, the terms "leading" and "trailing" may be used and/or understood as being similar in description as the terms "forward" and "aft," respectively. "Leading" may be used to describe, for example, a surface of a swirler vane over which a fluid initially flows, and "trailing" may be used to describe a surface of the swirler vane over which the fluid finally flows.

Figure 1:
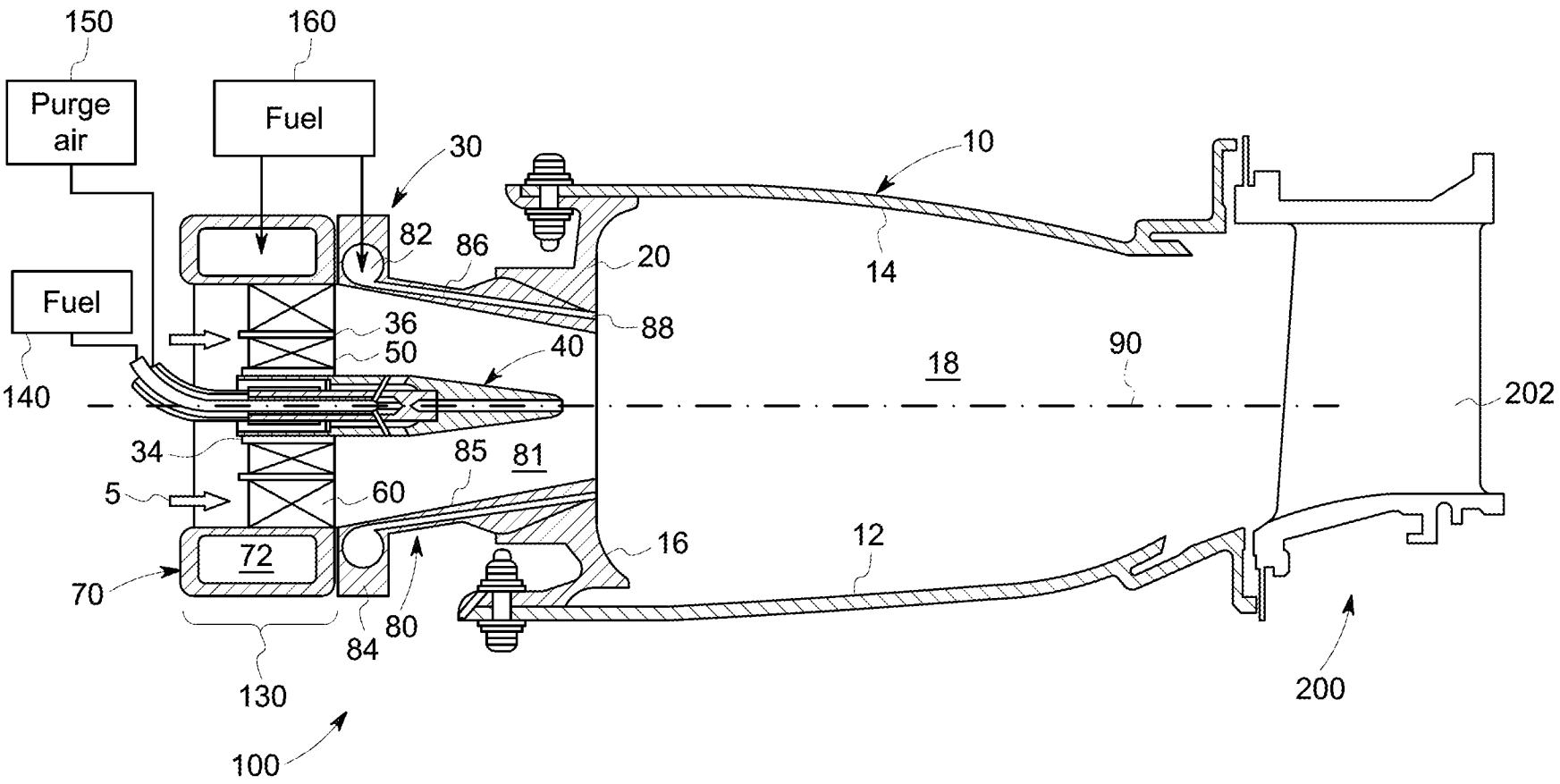
FIG. 1 shows a partial cross-sectional side view through an annular combustor including a premixer, according to one aspect of the present disclosure.

It is often required to describe parts that are at differing radial, axial and/or circumferential positions. As shown in FIG. 1, the "A" axis represents an axial orientation. As used herein, the terms "axial" and/or "axially" refer to the relative position/direction of objects along axis A, which is substantially parallel with the longitudinal axis of the annular combustor. As further used herein, the terms "radial" and/or "radially" refer to the relative position or direction of objects along an axis "R", which is substantially perpendicular with axis A and intersects axis A at only one location. Finally, the term "circumferential" refers to movement or position around axis A (e.g., in a rotation "C"). The term "circumferential" may refer to a dimension extending around a center of any particular axis (e.g., extending around the longitudinal axis of the premixer centerbody).

When introducing elements of various embodiments of the present technology, the articles "a," "an," and "the" are intended to mean that there are one or more of the elements. The terms "comprising," "including," and "having" are intended to be inclusive and mean that there may be additional elements other than the listed elements.

FIG. 1 illustrates a partial cross-sectional side view through an annular combustor 100 of the type suitable for use in a gas turbine engine having a turbine section 200, including a first stage nozzle 202. The annular combustor 100 includes a hollow body 10 that is generally annular in form. The hollow body 10 is defined along its sides by an inner liner 12 and an outer liner 14 and is bounded at an upstream end by a domed end or dome 16. The body 10 defines an annular combustion chamber 18 axially downstream of the dome 16. The domed end 16 of the hollow body 10 includes a mounting cup 20 within which a dual fuel premixer 30 is disposed.

The dual fuel premixer 30 promotes the uniform mixing of fuel and air upstream of the combustion chamber 18 and subsequently introduces the fuel/air mixture into the combustion chamber 18. The uniform mixing of the fuel and air helps to minimize the formation of pollutants, such as nitrous oxides ("NOx"), produced during the combustion of the fuel/air mixture.

The dual fuel premixer 30 includes a swirler assembly 130, a centerbody 40 extending through the swirler assembly 130, and a mixing duct 80 extending downstream of the swirler assembly 130 and surrounding the centerbody 40. The swirler assembly 130 includes a radially inner array 50 of swirler vanes 52 that rotate air in a first direction and a radially outer array 60 of swirler vanes 62 that rotate air in a second direction opposite the first direction. Such an arrangement is known as a "counter-rotating" swirler. The vanes 52 extend radially between a hub 34 that partially surrounds the centerbody 40 and an annular splitter 36 that separates the air stream flowing over the vanes 52 from the air stream flowing over the vanes 62. The vanes 62 extend radially between the annular splitter 36 and an outer ring 70 that defines an outer perimeter of the fuel premixer 30.

More specifically, proceeding radially outward from a longitudinal axis 90 of the dual fuel premixer 30, the swirler assembly 130 includes the hub 34 partially surrounding the centerbody 40, the first array 50 of inner swirler vanes 52 extending from the hub 34, the annular splitter 36 surrounding the hub 34 and the first array 50 of inner swirler vanes 52, the second array 60 of outer swirler vanes 62 extending radially outward of the annular splitter 36, the outer ring 70 surrounding the annular splitter 36 and the second array 60 of outer swirler vanes 62. The first array 50 of inner swirler vanes 52 may be referred to as an "inner swirler" (also noted with the number 50), and the second array 60 of outer swirler vanes 62 may be referred to as an "outer swirler" (also noted with the number 60).

In embodiments of the dual fuel premixer 30 described herein, the centerbody 40 delivers the liquid fuel during liquid fuel operation, and the vanes 62 of the outer swirler 60 deliver gaseous fuel from a primary fuel plenum 72 defined in the outer ring 70 during gaseous fuel operation. Details of this assembly and its operation are provided below.

Figure 2:
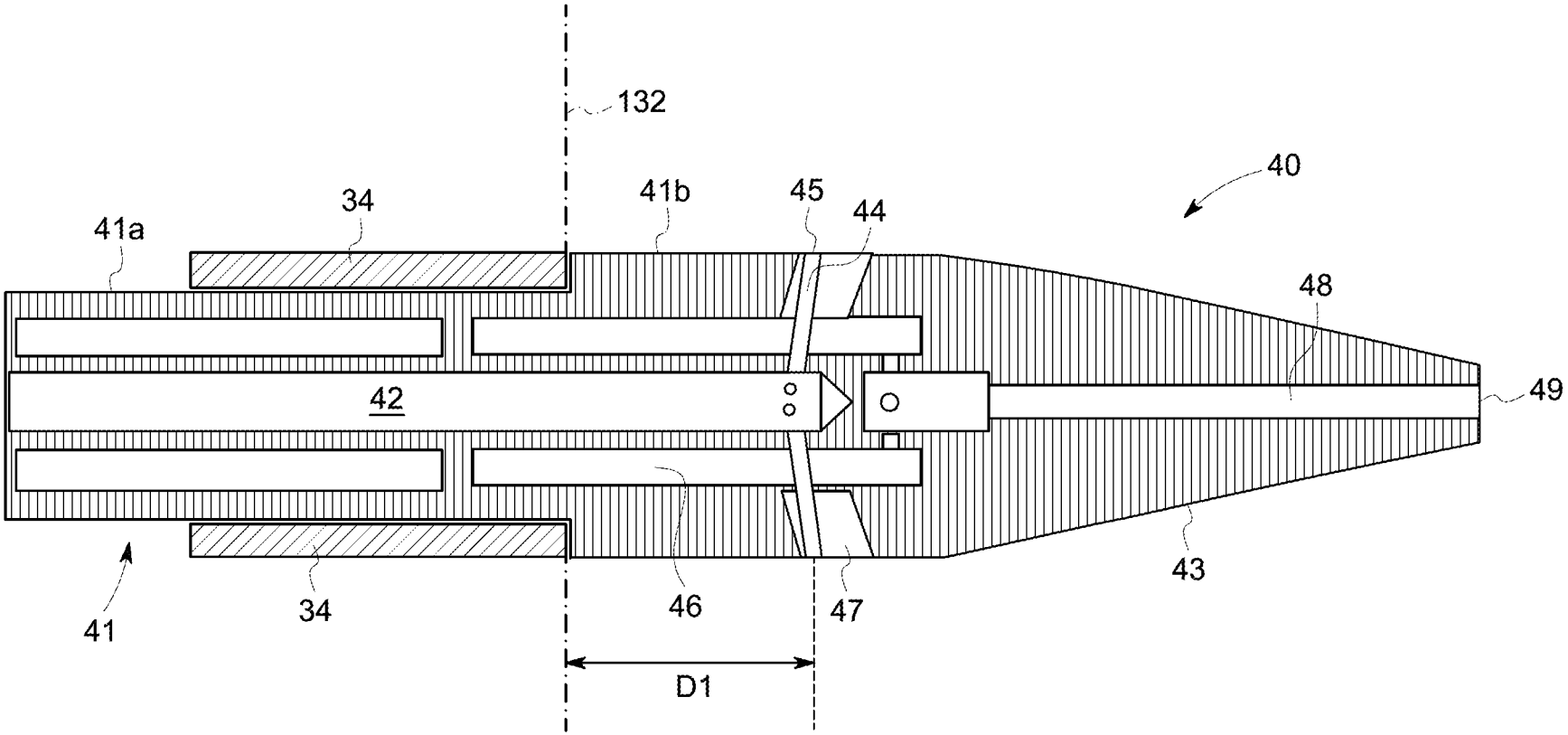
FIG. 2 is a schematic illustration of a centerbody of the premixer of FIG. 1.

The centerbody 40 is disposed along the longitudinal axis 90 of the dual fuel premixer 30 and defines a fuel passage 42 through the centerbody 40. The centerbody 40 has a cylindrical upstream portion 41 and a conical, or tapering, downstream portion 43. The cylindrical upstream portion 41 extends through and axially downstream of the swirler assembly 130 (as represented by plane 132) and terminates within the mixing duct 80. As shown in FIG. 2, the cylindrical upstream portion 41 has a first diameter 41*a* upstream of the mixing duct 80 and a second, slightly larger diameter 41*b* within the mixing duct 80. The conical portion 43 has a diameter that decreases substantially uniformly in the axial direction from the second diameter to a third diameter at its tip, the third diameter being smaller than both the first diameter and the second diameter.

Fuel channels 44 are disposed circumferentially around the fuel passage 42 and extend radially outward from the fuel passage 42 to the surface of the cylindrical portion 41 where the fuel channels 44 terminate in fuel ports 45. The fuel ports 45 are positioned downstream of the swirler assembly 130 that includes the inner swirler 50 and the outer swirler 60.

Fuel from a centerbody fuel source 140 is supplied to the fuel passage 44 from which the fuel travels through the fuel channels 44 and exits the fuel ports 45 to be mixed with air in the mixing duct 80. In one embodiment, the centerbody fuel source 140 may supply liquid fuel or a mixture of liquid fuel and water. By positioning the fuel ports 45 in close proximity to the inner swirler 50 and the outer swirler 60, the residence time of the fuel-air mixture within the mixing duct 80 is increased. While the number, size, and angle of the multiple fuel ports 45 is dependent on the amount of fuel supplied thereto, the pressure of the fuel, and the design of swirlers 50 and 60, it has been found that four to twelve fuel ports work adequately.

In one example (as shown in FIG. 1), the centerbody 40 is in fluid communication with a purge air supply 150 that is delivered via a concentric tube-in-tube arrangement in which the purge air is fed into a conduit 152 that surrounds the fuel passage 42. In another example, a portion of air 5 from the compressor may be utilized to supply air into the centerbody fuel injector 40.

Figure 3:
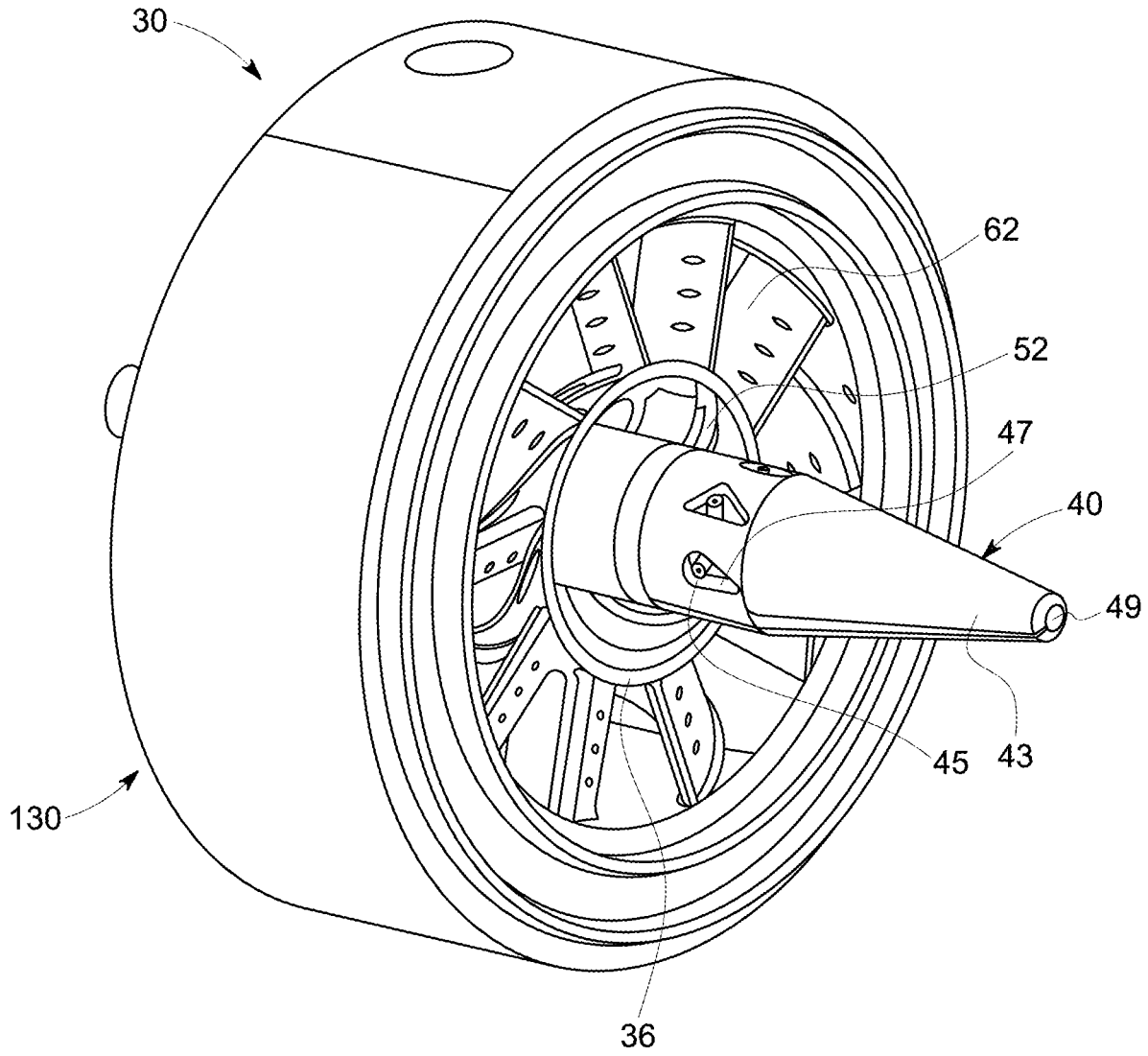
FIG. 3 is a perspective view of the premixer of FIG. 1, in which a downstream mixing duct has been omitted to permit visibility of the centerbody.

The centerbody 40 may further define an annular air plenum 46 that is disposed radially outward of the fuel passage 42. The air plenum 46, which receives air from the purge air supply 150 or a portion of the compressor air 5, helps to maintain the liquid fuel at the appropriate temperature (e.g., to prevent coking). A first portion of air from the air plenum 46 is directed through air vents 47 that surround the fuel ports 45 (also shown in FIG. 3). The air vents 47 may have a teardrop shape, and the narrower end of the teardrop shape may be oriented toward the downstream end of the centerbody 40. The air vents 47 deliver air that acts as a shield layer to prevent the fuel from entering the centerbody recirculation zone (shown in FIG. 7) and from wetting the surface of the centerbody 40. This shield layer prevents auto-ignition of the fuel-air mixture within the mixing chamber 81 and possible flame-holding in the mixing duct 80. When the premixer 30 is operating only on gaseous fuel, the air vents 47 continue to deliver air to prevent the creation of recirculation zones and to promote mixing of the gaseous fuel and air within the mixing duct 80.

A second portion of air from the air plenum 46 is directed through a tip air passage 48 that extends axially through the conical portion 43 of the of the centerbody and terminates in an air outlet 49 at a distal end thereof. The air outlet 49 directs air of a relatively high axial velocity into combustion chamber 18 (shown in FIG. 1), thus decreasing the local fuel/air ratio and helping to push the flame downstream of conical portion 43.

The hub 34 circumferentially surrounds a portion of the centerbody 40 upstream of the fuel ports 45. The hub 34 provides a surface to which the inner swirler vanes 52 of the inner swirler 50 are attached. The centerbody 40 is assembled into the hub 34 from the downstream end, such that the cylindrical portion 41 having the first diameter (41*a*) slides into and through the hub 34, and the cylindrical portion 41 having the second diameter (41*b*) engages the axial end of the hub 34, thus ensuring the desired distance D1 between the fuel ports 45 and an outlet plane 132 of the swirler assembly 130. The hub 34 and the centerbody 40 are joined together, for example, by a continuous weld, to prevent air leakage between the interior surface of the hub 34 and the outer surface of the centerbody 40 (specifically, portion 41*a*).

The annular splitter 36 circumferentially surrounds and is radially outward of the hub 34. The annular splitter 36 includes a radially inner surface to which the inner swirler vanes 52 are attached and a radially outer surface to which the outer swirler vanes 62 are attached. The annular splitter 36 allows the inner swirler 50 and the outer swirler 60 to be co-annular and still separately rotate air entering the upstream end of the swirler assembly 130. Because of the annular splitter 36, the air passing over the inner swirler vanes 52 is rotated in an opposite direction to the air passing over the outer swirler vanes 62.

The annular splitter 36 performs another function in promoting the mixing of the fuel-air mixture. Specifically, the blockage of air flow caused by the splitter 36 leads to shear layers of air downstream of the splitter 36. These shear layers are effective at preventing recirculation zones from forming upstream of the fuel injection ports 45 alongside the centerbody 40. For this reason, it is advantageous to set the D1 distance to fall within the area in which the shear layers are produced to promote fuel-air mixing.

Figure 4:
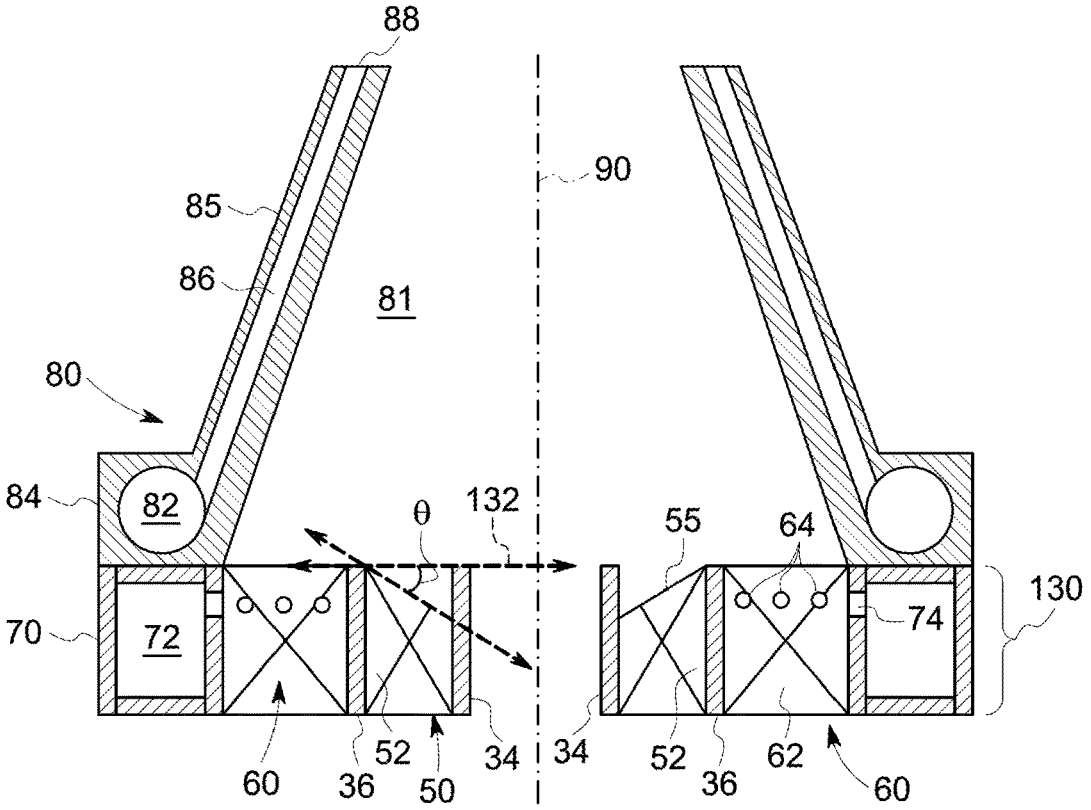
FIG. 4 is a schematic illustration of the premixer of FIG. 1, depicting an angle of inclination between a trailing edge of an inner swirler vane and an outlet plane of a swirler assembly, the centerbody having been omitted for clarity.

The first array 50 of inner swirler vanes 52 extends between the hub 34 and the annular splitter 36 to impart swirl in a first direction to a flow of incoming air 5. Each swirler vane 52 of the inner swirler 50 has a leading edge 57 (shown in FIG. 8) facing into the flow of incoming air 5 and a trailing edge 55 facing the mixing chamber 81 of the mixing duct. The trailing edge 55 of each swirler vane 52 has an aerodynamically contoured shape, in which the trailing edge 55 of the vane 52 is positioned at an oblique angle θ (theta) relative to the outlet plane 132 of the swirler assembly 130, as schematically illustrated in FIG. 4 (the centerbody 40 being omitted for clarity). The oblique angle θ (theta) is between 1 degree and 55 degrees. In some embodiments, the oblique angle θ (theta) is between 20 degrees and 55 degrees. In some embodiments, the oblique angle θ (theta) is between 30 degrees and 45 degrees. In other embodiments, the oblique angle θ (theta) is 45 degrees.

Figure 5:
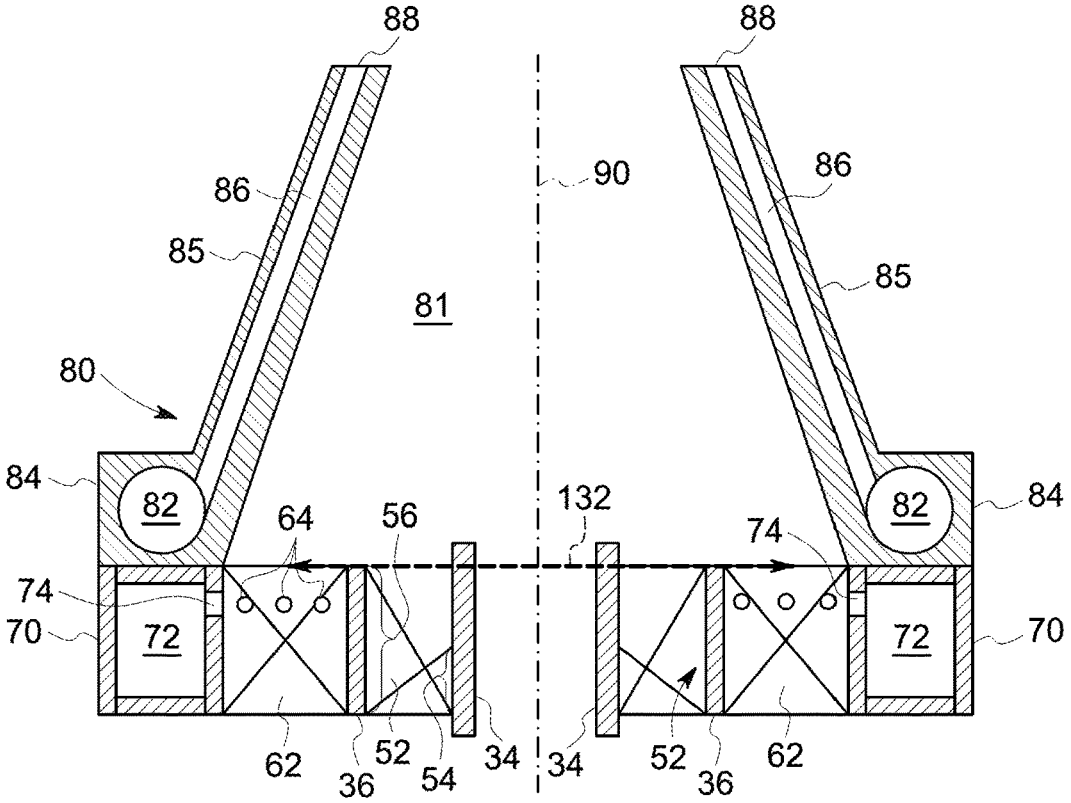
FIG. 5 is an alternate schematic illustration of the premixer of FIG. 4, in which the centerbody has been omitted for clarity.

Each swirler vane 52 extends radially between the hub 34 and the annular splitter 36. Each swirler vane 52 of the inner swirler 50 has a first portion 54 connected to the hub 34 and a second portion 56 connected to the annular splitter 36, as schematically illustrated in FIG. 5 (the centerbody 40 being omitted for clarity). The first portion 54 is shorter than the second portion 56, due to the aerodynamically contoured shape of the trailing edge 55.

The second array 60 of outer swirler vanes 62 extends between the annular splitter 36 and the primary fuel plenum 72 defined by the outer ring 70. The outer swirler vanes 62 are configured to impart swirl to the flow of incoming air in a direction opposite the direction produced by the inner swirler 50. Each outer swirler vane 62 of the second array 60 defines at least one fuel metering hole 64 therein in fluid communication with the primary fuel plenum 72, via a fuel flow passage 74 in the outer ring 70.

Figure 6:
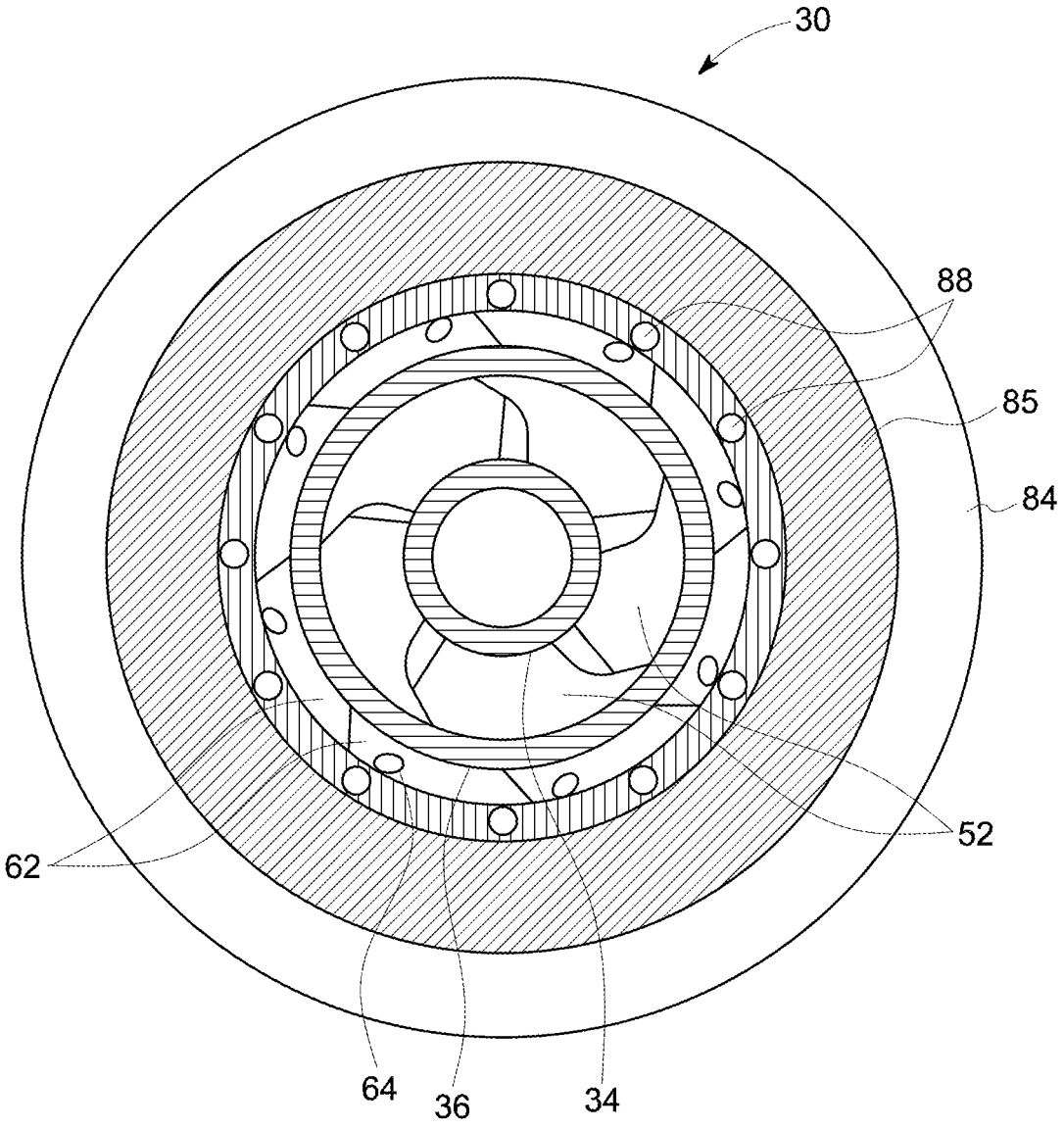
FIG. 6 is a plan, aft-looking-forward view of the premixer of FIG. 1.

The outer ring 70, which circumferentially surrounds and is radially outward of the annular splitter 36, defines the primary fuel plenum 72 within the body of the outer ring 70. As discussed above, gaseous fuel from a gaseous fuel source 160 (shown in FIGS. 1 and 6) is received within the primary fuel plenum 72 and is conveyed through the fuel passage 74 into the outer swirler vanes 62 for injection into the mixing chamber 81 via the fuel metering holes 74. Delivery of fuel from the outer ring 70 occurs during periods of gaseous fuel operation.

With reference to FIGS. 1, 4, and 5, the mixing duct 80, which is attached to and extends downstream from the outer ring 70, includes a secondary fuel manifold 84 at an upstream end and a conical wall 85 that defines the mixing chamber 81 and that extends downstream from the secondary fuel manifold 84. The mixing chamber 81 is configured to promote mixing of the flow of incoming air and fuel, whether the dual fuel premixer 30 is operating on liquid fuel delivered from the centerbody 40 or gaseous fuel delivered from the outer swirler vanes 62. The mixing duct 80 allows uniform mixing of a high-pressure air from a compressor (not shown) flowing through the inner swirler 50 and the outer swirler 60 with fuel injected from the centerbody 40 or the outer swirler vanes 62.

The secondary fuel manifold 84 defines a secondary fuel plenum 82, which is supplied by the gaseous fuel supply 160 when the dual fuel premixer 30 is operating on gaseous fuel. A series of secondary fuel passages 86 in fluid communication with the secondary fuel plenum 82 are defined through the conical wall 85 and terminate in secondary fuel outlets 88 at the downstream end of the mixing duct 80. It is contemplated that from eight to thirty-two secondary fuel passages 86 may be employed. The passages 86 are preferably straight passages between the secondary fuel plenum 82 and the outlets 88. Preferably, the passages 86 are evenly distributed about the circumference of the conical wall 85. The outlets 88 of the passages 86 may be seen most clearly in FIG. 6, which illustrates a view of the dual fuel premixer 30 from an aft position looking forward.

Figure 7:
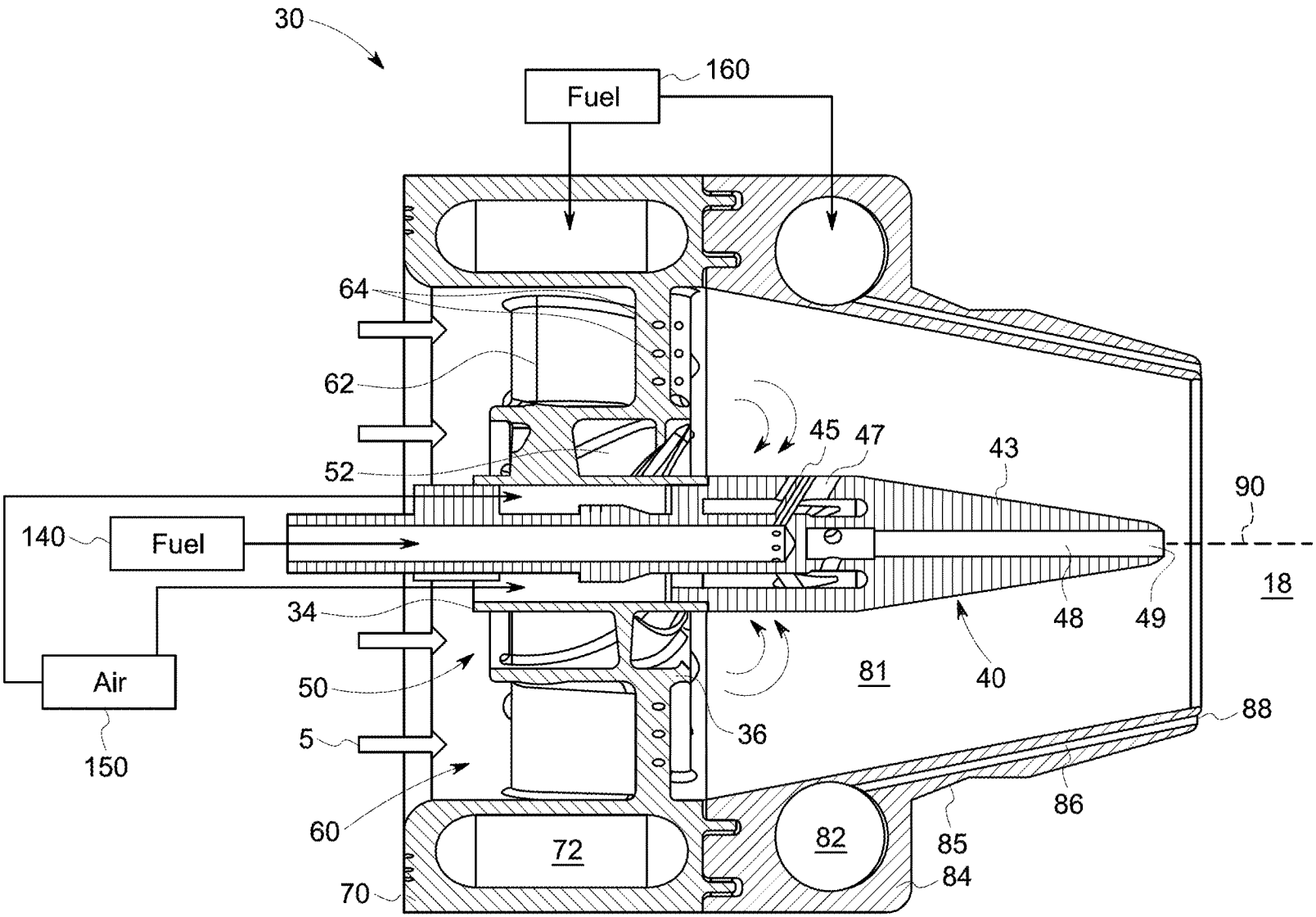
FIG. 7 is an enlarged, cross-sectional side view of the premixer of FIG. 1.

The operation of the dual fuel premixer 30 is discussed with reference to FIG. 7. During liquid fuel operation, compressed air 5 from a compressor (not shown) is injected into the upstream end of the dual fuel premixer 30, where it passes through the inner swirler 50 and the outer swirler 60. As discussed above, the inner swirler 50 imparts a swirl in a first direction to the air flowing over and between the inner swirler vanes 52, and the outer swirler 60 imparts a swirl in a second, opposite direction to the air flowing over and between the outer swirler vanes 62. Liquid fuel from a liquid fuel source 140 is injected, via fuel ports 45, into the air flow streams existing the swirler vanes 52, 62, which include intense shear layers downstream of the annular splitter 36 and boundary layers along the centerbody 40 and the wall 85 of the mixing duct 80. The shear layers and the counter-swirling air flows produced by the inner swirler 50 and the outer swirler 60 promote thorough mixing of the liquid fuel with air within the mixing duct 80. In one example, the angle of the multiple fuel ports 45, relative to the longitudinal axis 90, is aligned with the inner-swirling air flow angle to facilitate the fuel jets being carried into the shear layers, thereby promoting fuel-air mixing for reduced NOx emission.

Purge air 150 (or additional streams of compressor air 5) are directed through the centerbody 40 alongside the fuel passage 42. The air is directed outward from the air vents 47 as a co-axial flow with the liquid fuel. The air from the air vents helps to prevent the liquid fuel from depositing on the outer surface of the centerbody 40, where its presence may lead to auto-ignition or flame-holding problems. Additionally, air is directed through the tip air passage 48 and exits the centerbody 40, via the outlet 49, to push the fuel-air mixture from the mixing chamber 81 into the combustion chamber 18 (shown in FIG. 1).

During gaseous fuel operation, the liquid fuel source 140 does not deliver liquid fuel, and gaseous fuel from the gaseous fuel source 160 is delivered to the primary gaseous fuel plenum 72 defined within the outer ring 70 and to the secondary gaseous fuel plenum 82 defined within the secondary fuel manifold 84 of the mixing duct 80. Gaseous fuel from the primary fuel plenum 72 is directed through fuel flow passages 74 (shown in FIG. 4) into the outer swirler vanes 62 of the outer swirler 60, from which the fuel is injected via fuel metering holes 64 on each vane 62. The fuel injected from the outer swirler vanes 62 mixes with air 5 flowing over and between the outer swirler vanes 62, as the fuel enters the mixing chamber 81.

Additionally, fuel from the gaseous fuel source 160 flows from the secondary fuel plenum 82 defined within the secondary fuel manifold 84 into a series of secondary fuel passages 86 extending through the conical wall 85 of the mixing duct 80. The fuel from the secondary fuel passages 86 exits the mixing duct 80 through a corresponding series of secondary fuel outlets 88 defined in the aft end of the mixing duct (shown in FIG. 6). The fuel passing through the secondary fuel passages 86 provides an additional volume of fuel for combustion and helps to cool the mixing duct 80 as well.

Figure 8:
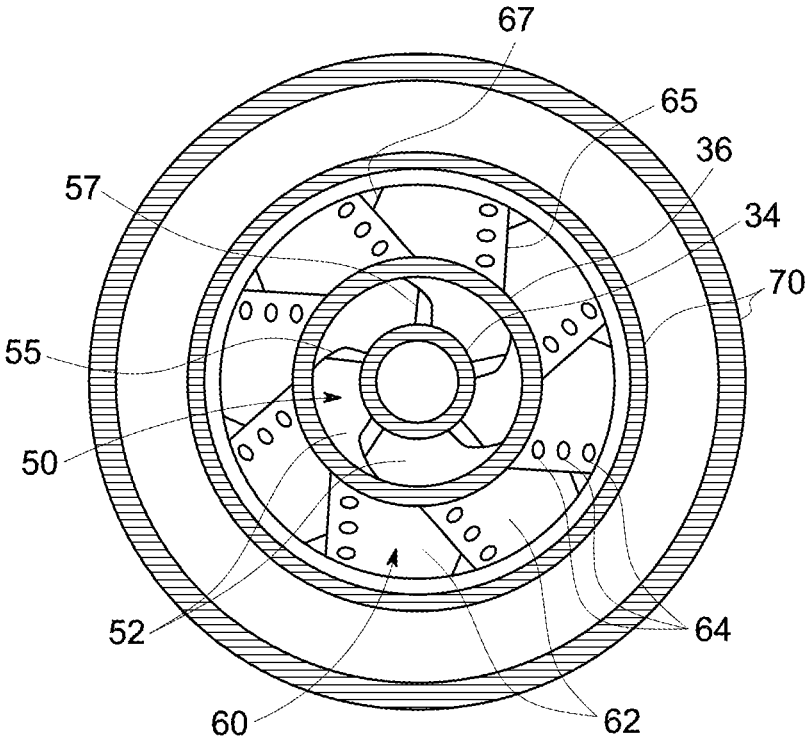
FIG. 8 is a plan, aft-looking-forward view of a first array of inner swirler vanes and a second array of outer swirler vanes of the premixer of FIG. 1, according to a first aspect provided herein.

FIG. 8 illustrates an aft-looking-forward plan view of a first embodiment of the swirler assembly 130, in which the centerbody 40 and the mixing duct 80 are removed. The inner swirler 50 includes five swirler vanes 52 that extend radially between the hub 34 and the annular splitter 36. Each inner swirler vane 52 has a leading edge 57 and a trailing edge 55. The outer swirler 60 includes a larger number of vanes 62 (for example, from eight to fifteen) than the inner swirler 50 that extend radially between the annular splitter 36 and the outer ring 70. Each outer swirler vane 62 has a leading edge 67 and a trailing edge 65. The inner swirler vanes 52 may extend over a shorter radial distance than the outer swirler vanes 62, in some embodiments.

Figure 9:
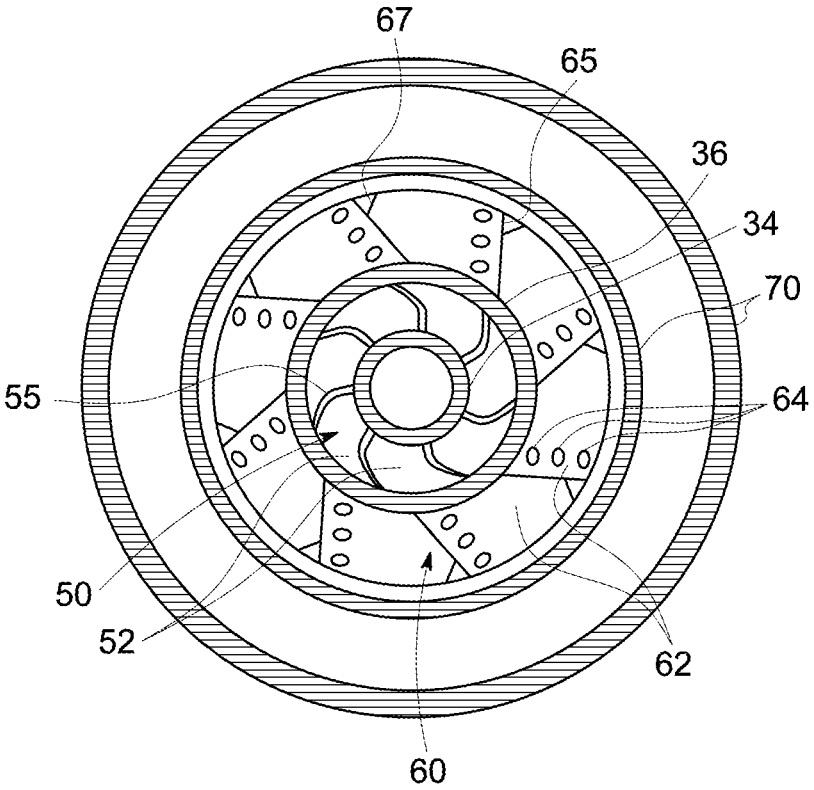
FIG. 9 is a plan, aft-looking-forward view of a first array of inner swirler vanes and a second array of outer swirler vanes of the dual fuel premixer of FIG. 1, according to a second aspect provided herein.

FIG. 9 illustrates an aft-looking-forward plan view of a second embodiment of the swirler assembly 130, in which the centerbody 40 and the mixing duct 80 are removed. The inner swirler 50 includes seven swirler vanes 52 that extend radially between the annular splitter and the outer ring 70. Because of the larger number of vanes 52, the trailing edges 55 disrupt a line of sight between the leading edge 57 and the mixing chamber 81. The outer swirler 60 includes a larger number of vanes 62 (for example, from eight to fifteen) than the inner swirler 50 that extend radially between the annular splitter 36 and the outer ring 70. The inner swirler vanes 52 may extend over a shorter radial distance than the outer swirler vanes 62, in some embodiments.

Although FIGS. 8 and 9 illustrate inner swirlers 50 with five swirler vanes and seven swirler vanes, respectively, the present disclosure is not limited to inner swirlers 50 with those numbers of vanes. Rather, the number of inner swirler vanes 52 may range from three to eleven.

Figure 10:
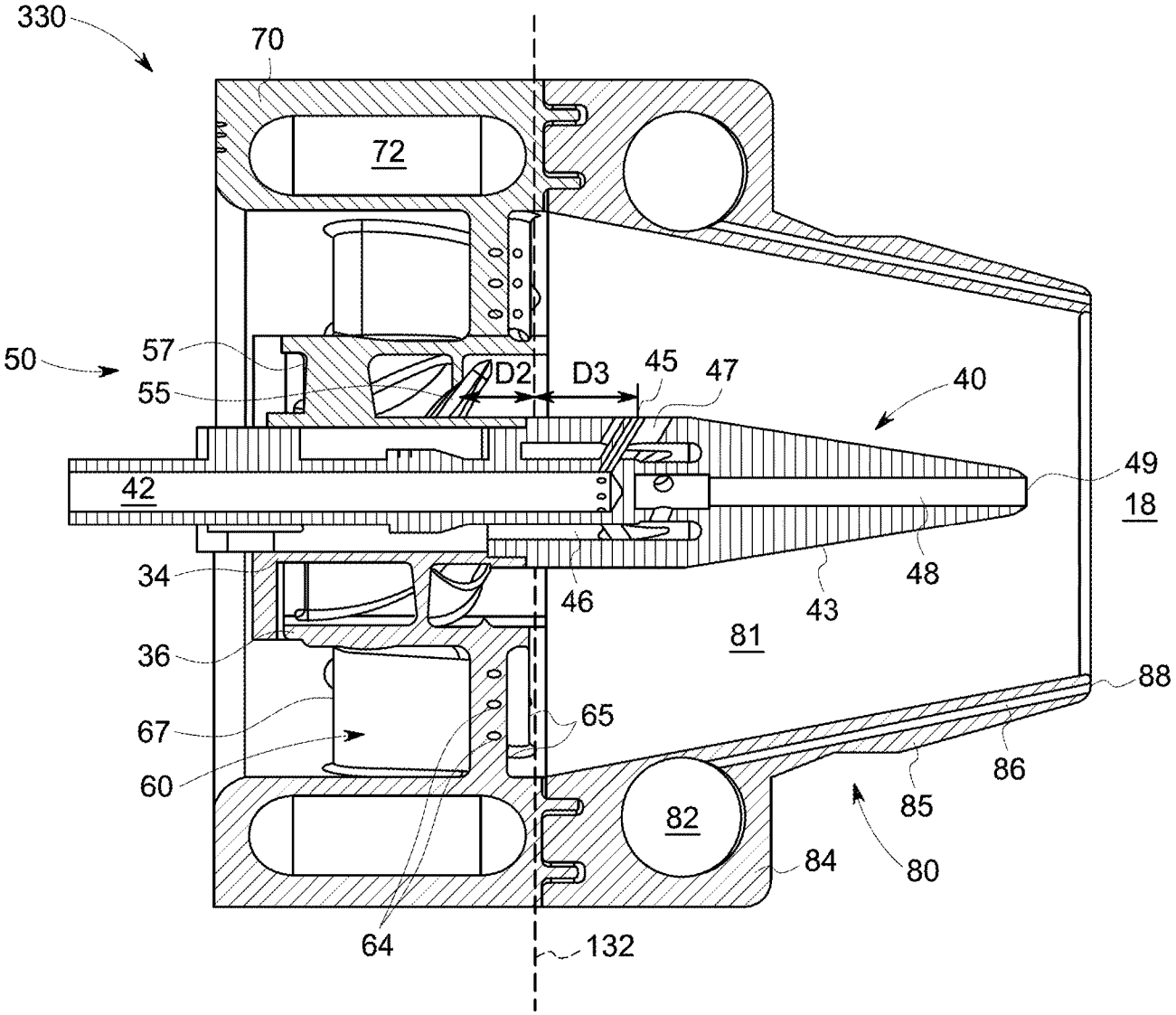
FIG. 10 is an enlarged, cross-sectional side view of the premixer of FIG. 1, in which the first array of inner swirler vanes are axially offset from the second array of outer swirler vanes, according to another aspect provided herein.
Figure 11:
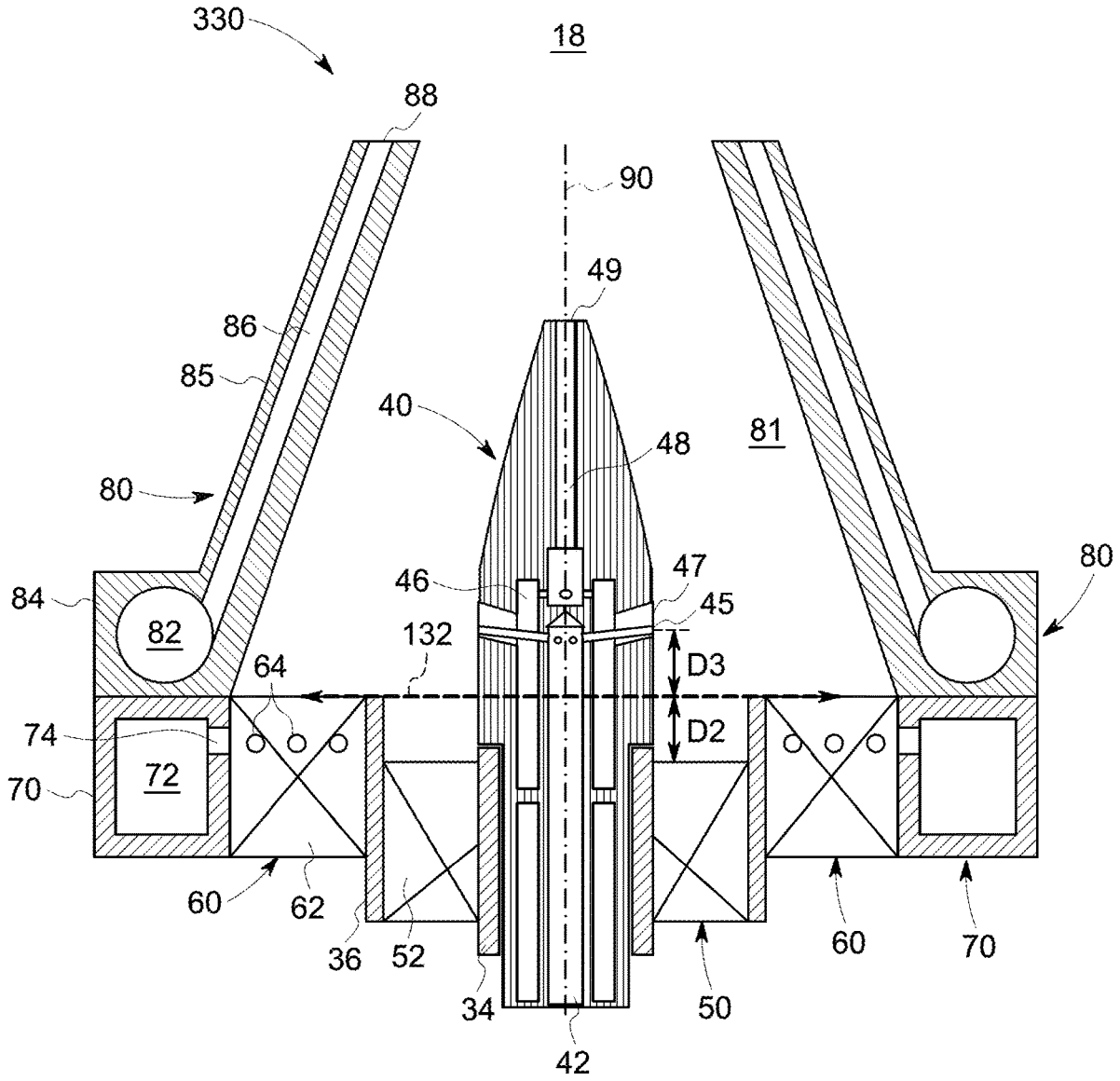
FIG. 11 is a schematic illustration of the premixer of FIG. 10.

FIGS. 10 and 11 illustrate an alternate embodiment of a dual fuel premixer 330, in which the inner swirler vanes 52 and the hub 34 are moved upstream of the outlet plane 132 defined by trailing edges of the outer swirler vanes 62. Said differently, the inner swirler vanes 52 are axially offset from the outer swirler vanes 62 in an upstream direction by a predetermined offset distance D2. As a result, the centerbody 40 is also moved upstream, reducing the distance D3 between the fuel ports 45 and the outlet plane 132 of the outer swirler vanes 62, as compared to the premixer 30 with axially aligned inner and outer swirlers 50, 60. Thus, the fuel injected by the fuel ports 45 has a longer residence time within the mixing chamber 81 and is likely to experience a greater degree of mixing with swirled air from the inner swirler 50 and the outer swirler 60, especially the shear layers produced by the annular splitter 36. Such an assembly may be effective at mitigating combustion dynamics.

Figure 12:
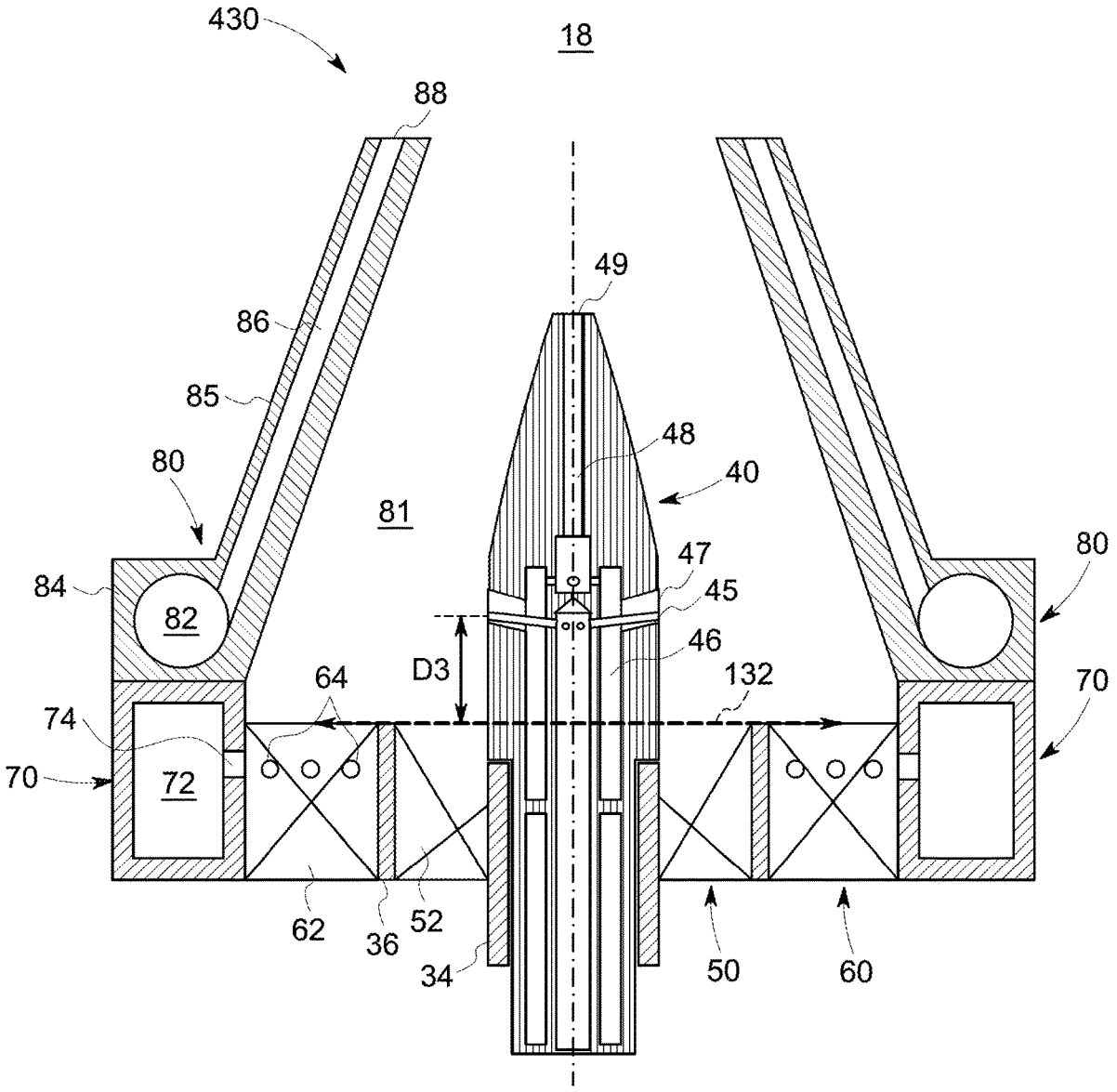
FIG. 12 is an enlarged, cross-sectional side view of the premixer of FIG. 1, in which the first array of inner swirler vanes and the second array of outer swirler vanes are axially offset from the upstream end of a mixing duct, according to another aspect provided herein.

FIG. 12 illustrates yet another embodiment of a dual fuel premixer 430, in which the centerbody 40, the hub 34, the inner swirler vanes 52, the annular splitter 36, and the outer swirler vanes 62 are moved upstream to increase their distance from the outlet of the mixing duct 80. As a result, gaseous fuel introduced by the outer swirler vanes 62 has a greater residence time within the mixing chamber 81, which promotes fuel/air mixing and thereby reduces NOx emissions resulting from the combustion of the fuel/air mixture. Because the hub 34 and the centerbody 40 are moved upstream (i.e., further away from the outlet of the mixing duct 80) along with the swirlers 50, 60, the residence time of liquid fuel injected from the fuel ports 45 is increased, promoting the mixing of the liquid fuel and air and thereby reducing NOx emissions resulting from the combustion of the liquid fuel/air mixture, when the premixer 430 operates on liquid fuel.

Advantageously, the present premixers ensure sufficient fuel-air mixing in the mixing duct necessary to positively impact (i.e., reduce) NOx emissions. Further, the present premixers prevents formation of recirculation zones around the centerbody fuel injector due to the flow of swirling air from the inner swirler by virtue of the aerodynamically contoured trailing edges. The air flow through the swirler vanes—and particularly, the aerodynamically shaped inner swirler vanes—increases the axial velocity in the near-centerbody region, thus changing the axial velocity profile and eliminating the recirculation zone. The location of the fuel ports along the centerbody provides the fuel sufficient residence time inside the fuel-air mixer to achieve thorough fuel-air premixing without permitting the fuel to be trapped in the recirculation zone, where it could lead to auto-ignition.

Furthermore, the skilled artisan will recognize the interchangeability of various features from different examples. Similarly, the various methods and features described, as well as other known equivalents for each such methods and feature, can be mixed and matched by one of ordinary skill in this art to construct additional systems and techniques in accordance with principles of this disclosure. Of course, it is to be understood that not necessarily all such objects or advantages described above may be achieved in accordance with any particular example. For example, those skilled in the art will recognize that the systems and techniques described herein may be embodied or carried out in a manner that achieves or improves one advantage or group of advantages as taught herein without necessarily achieving other objects or advantages as may be taught or suggested herein.

While only certain features of the technology have been illustrated and described herein, many modifications and changes will occur to those skilled in the art. It is, therefore, to be understood that the appended claims are intended to cover all such modifications and changes as fall within the true spirit of the claimed inventions.

What is claimed is:

1. A premixer comprising:

a centerbody disposed along a longitudinal axis of the premixer, the centerbody defining a fuel passage therethrough and a plurality of fuel ports in communication with the fuel passage and defined through a centerbody wall;

a swirler assembly comprising:

a hub circumferentially surrounding a portion of the centerbody upstream of the plurality of fuel ports;

an annular splitter circumferentially surrounding and radially outward of the hub;

an inner swirler comprising inner swirler vanes extending between the hub and the annular splitter to impart swirl in a first direction to a flow of incoming air; and an outer swirler comprising outer swirler vanes extending radially outward of the annular splitter to impart swirl in a second direction opposite the first direction to the flow of incoming air, the outer swirler defining an outlet plane;

a mixing duct extending downstream from the swirler assembly, the mixing duct defining a mixing chamber configured to promote mixing of the flow of incoming air and fuel, wherein each inner swirler vane of the inner swirler includes a trailing edge disposed at an oblique angle relative to the outlet plane, and wherein the inner swirler vanes are axially offset from the outer swirler vanes in the upstream direction such that the fuel ports are axially closer to the outer swirler vanes than the inner swirler vanes; and an outer ring circumferentially surrounding and radially outward of the outer swirler, the outer ring defining a primary fuel plenum therein, wherein the mixing duct comprises a secondary fuel manifold defining a secondary fuel plenum proximate to the primary fuel plenum, wherein a conical wall extends downstream from the secondary fuel manifold, the conical wall defining a series of secondary fuel passages that extend from the secondary fuel plenum to respective secondary fuel outlets on a downstream end of the mixing duct.

2. The premixer of claim 1, wherein the oblique angle is from 20 degrees to 55 degrees.

3. The premixer of claim 2, wherein the oblique angle is a 45-degree angle.

4. The premixer of claim 1, wherein the inner swirler has from three inner swirler vanes to eleven inner swirler vanes.

5. The premixer of claim 1, wherein the series of secondary fuel passages has from eight to thirty-two passages.

6. The premixer of claim 1, wherein the centerbody comprises a cylindrical upstream portion and a conical downstream portion, the plurality of fuel ports being defined through the centerbody wall in the cylindrical upstream portion.

7. The premixer of claim 6, wherein the cylindrical upstream portion of the centerbody comprises a first portion having a first diameter and extending through the hub and a second portion having a second diameter extending axially downstream of the hub, the first portion having a smaller diameter than the second portion, and the second portion engaging the hub.

8. A dual fuel premixer comprising:

a centerbody disposed along a longitudinal axis of the dual fuel premixer, the centerbody defining a fuel passage therethrough and a plurality of fuel ports in communication with the fuel passage and defined through a centerbody wall;

a swirler assembly comprising:

a hub circumferentially surrounding a portion of the centerbody upstream of the plurality of fuel ports;

an annular splitter circumferentially surrounding and radially outward of the hub;

an outer ring circumferentially surrounding and radially outward of the annular splitter, the outer ring defining a primary fuel plenum therein;

a first array of inner swirler vanes extending between the hub and the annular splitter to impart swirl in a first direction to a flow of incoming air; and a second array of outer swirler vanes extending between the annular splitter and the primary fuel plenum to impart swirl in a second direction opposite the first direction to the flow of incoming air, each outer swirler vane of the second array defining at least one fuel metering hole therein in fluid communication with the primary fuel plenum, the second array of outer swirler vanes defining an outlet plane; and a mixing duct extending downstream from the primary fuel plenum, the mixing duct defining a mixing chamber configured to promote mixing of the flow of incoming air and fuel, wherein each inner swirler vane of the first array has a first portion connected to the hub and a second portion connected to the annular splitter, the first portion being shorter than the second portion, such that an oblique angle is defined between a trailing edge of each inner swirler vane and the outlet plane of the second array of outer swirler vanes, wherein the inner swirler vanes are axially offset from the outer swirler vanes in the upstream direction such that the fuel ports are axially closer to the outer swirler vanes than the inner swirler vanes, and wherein the trailing edge of each inner swirler vane curves circumferentially at an increasing rate from the first portion to the second portion.

9. The dual fuel premixer of claim 8, wherein the oblique angle is from 20 degrees to 55 degrees.

10. The dual fuel premixer of claim 9, wherein the oblique angle is a 45-degree angle.

11. The dual fuel premixer of claim 8, wherein the first array of inner swirler vanes has from three inner swirler vanes to eleven inner swirler vanes.

12. The dual fuel premixer of claim 8, wherein the mixing duct comprises a secondary fuel manifold defining a secondary fuel plenum proximate to the primary fuel plenum;

and a conical wall extending downstream from the secondary fuel manifold, the conical wall defining a series of secondary fuel passages that extend from the secondary fuel plenum to respective secondary fuel outlets on a downstream end of the mixing duct.

13. The dual fuel premixer of claim 12, wherein the series of secondary fuel passages has from eight to thirty-two passages.

14. The dual fuel premixer of claim 8, wherein the centerbody comprises a cylindrical upstream portion and a conical downstream portion, the plurality of fuel ports being disposed through the centerbody wall in the cylindrical upstream portion.

15. The dual fuel premixer of claim 14, wherein the cylindrical upstream portion of the centerbody comprises a first portion having a first diameter and extending through the hub and a second portion having a second diameter extending axially downstream of the hub, the first portion having a smaller diameter than the second portion, and the second portion engaging the hub.

16. A premixer comprising:

a centerbody disposed along a longitudinal axis of the premixer, the centerbody defining a fuel passage therethrough and a plurality of fuel ports in communication with the fuel passage and defined through a centerbody wall;

a swirler assembly comprising:

a hub circumferentially surrounding a portion of the centerbody upstream of the plurality of fuel ports;

an annular splitter circumferentially surrounding and radially outward of the hub;

an inner swirler comprising inner swirler vanes extending between the hub and the annular splitter to impart swirl in a first direction to a flow of incoming air; and an outer swirler comprising outer swirler vanes extending radially outward of the annular splitter to impart swirl in a second direction opposite the first direction to the flow of incoming air, the outer swirler defining an outlet plane;

a mixing duct extending downstream from the swirler assembly, the mixing duct defining a mixing chamber configured to promote mixing of the flow of incoming air and fuel, wherein each inner swirler vane has a first portion connected to the hub and a second portion connected to the annular splitter, wherein each inner swirler vane of the inner swirler includes a trailing edge disposed at an oblique angle relative to the outlet plane, wherein the inner swirler vanes are axially offset from the outer swirler vanes in the upstream direction such that the fuel ports are axially closer to the outer swirler vanes than the inner swirler vanes, and wherein the trailing edge of each inner swirler vane curves circumferentially at an increasing rate from the first portion to the second portion.

17. The premixer of claim 16, wherein the oblique angle is from 20 degrees to 55 degrees.

18. The premixer of claim 17, wherein the oblique angle is a 45-degree angle.

19. The premixer of claim 16, wherein the inner swirler has from three inner swirler vanes to eleven inner swirler vanes.

* * * * *